US005743275A

United States Patent [19]

Dawson et al.

[11] Patent Number: 5,743,275

[45] Date of Patent: Apr. 28, 1998

[54] CIGARETTE MAKING MACHINE

[75] Inventors: John Dawson; Derek Henry Dyett, both of High Wycombe, United Kingdom

[73] Assignee: Molins PLC, Miltin Keynes, United Kingdom

[21] Appl. No.: 668,682

[22] Filed: Jun. 24, 1996

[30] Foreign Application Priority Data

| | | | |
|---|---|---|---|
| Jun. 24, 1995 | [GB] | United Kingdom | 9512938 |
| Jul. 14, 1995 | [GB] | United Kingdom | 9514452 |
| Oct. 7, 1995 | [GB] | United Kingdom | 9520555 |

[51] Int. Cl.[6] ..... A24C 5/14

[52] U.S. Cl. ..... 131/84.1; 131/84.4; 131/108

[58] Field of Search ..... 131/84.1–84.4, 131/108; 198/689.1

[56] References Cited

FOREIGN PATENT DOCUMENTS 980379 1/1965 United Kingdom .

*Primary Examiner*—Vincent Millin

*Attorney, Agent, or Firm*—Antonelli, Terry, Stout, & Kraus, LLP

[57] ABSTRACT

A cigarette making machine comprises a channel (104; 106/228; 230/319; 320) through which tobacco is showered onto the inside surface of a suction band (100; 102/232; 234/309; 310) passing around a number of pulleys having approximately vertical axes of rotation, so as to form on the band a cigarette filler stream (114 etc.) which passes around one of the pulleys (100A; 102A/236; 238/314; 318), while lying between the pulley and the band, and is then arranged to transfer to a second band (122; 124/204; 206/321; 322) which transports the filler stream towards a rod-forming device by which the filler stream is enclosed in a wrapper web to form a continuous cigarette rod. A twin-track cigarette making machine may comprise two such arrangements side-by-side and forming mirror-images of one another.

14 Claims, 11 Drawing Sheets

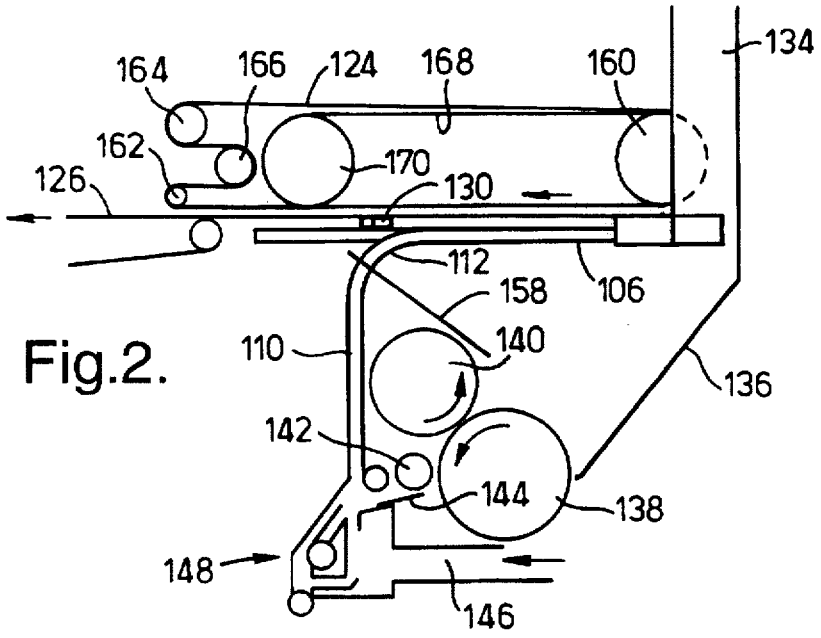
Fig.2.
Fig.5.
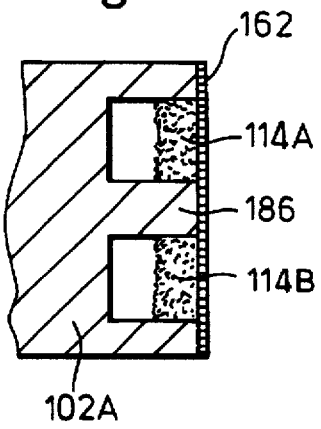
Fig.6.
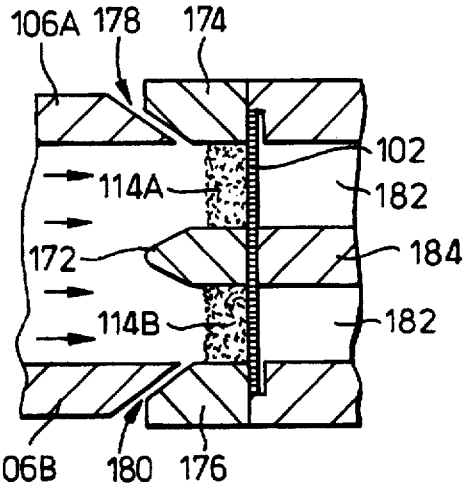
Fig.7.
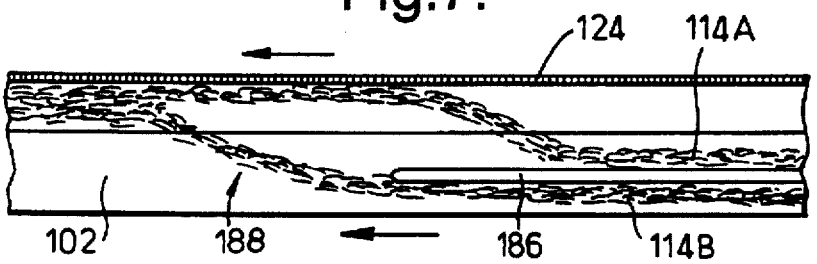

CIGARETTE MAKING MACHINE

Our British patent application No. 2294646 describes a twin track cigarette making machine comprising two substantially horizontal shower channels through which tobacco is arranged to be showered onto two suction bands moving in converging directions in a substantially horizontal plane and presenting substantially vertical tobacco-receiving surfaces so as to form a cigarette filler stream on each of the suction bands. Each of the filler streams is then transferred to the underneath surface of a further band by which it is carried to a rod-forming device by which the filler is enclosed in a continuous wrapper web. Thus two parallel cigarettes are formed, and these are cut at regular intervals to produce discrete rod lengths.

The present application is concerned particularly with twin track cigarette making machines but is also applicable to a single-track machine.

A cigarette making machine according to the present invention comprises a channel through which tobacco is showered onto the inside surface of a suction band passing around a number of pulleys having (in a preferred orientation) approximately vertical axes of rotation, so as to form on the band a cigarette filler stream which passes around one of the pulleys, while lying between the pulley and the band, and is then arranged to transfer to the outer surface of a second band which transports the filler stream towards a rod-forming device by which the filler stream is enclosed in a wrapper web to form a continuous cigarette rod.

One advantage of this arrangement is that it avoids any possibility of tobacco flying off the first band centrifugally while passing around the pulley, since the filler stream lies on the inside of the band. This arrangement also facilitates a compact form of machine construction.

The first band is preferably significantly wider than the second band and is arranged to receive the filler stream in a form which, in cross-section, is significantly wider than it is deep, the cross-section of the filler stream being arranged to change, upon transferring to the second band, so as to be narrower and deeper. By this means, the structure of the final filler stream can be improved, and in particular the "filling power" of the tobacco. In this connection reference is directed to our British patent application No. 2272828.

Other aspects and preferred features of this invention are described in the following specification and claims.

Examples of twin track cigarette making machines according to this invention are shown in the accompanying drawings: In these drawings:

FIG. 2 is a partly sectioned front view of the machine;

FIG. 5 shows a modified arrangement, equivalent to a section on the line A—A in FIG. 1 but on a still larger scale;

FIG. 6 is a section on the line C—C in FIG. 1 of the same modified arrangement;

FIG. 7 is a horizontal view showing diagrammatically the transfer of tobacco from one wide band to the overhead band in this modified arrangement;

The machine shown in FIGS. 1 to 4 comprises two bands 100 and 102 running in a horizontal plane respectively around pulleys 100A, 100B, 100C and 102A, 102B, 102C. These pulleys have vertical axes of rotation so that the bands have vertical surfaces in cross-section.

Portions of the bands running between pulleys 100A, 100B and 102A, 102B respectively converge and receive horizontally showered tobacco from shower channels 104 and 106; the tobacco is showered towards the bands in the direction of the triple parallel arrows shown in each shower channel, and it should be noted that the tobacco arrives at each band with a significant velocity component in the direction of movement of the respective bands. Each of these horizontal shower channels receives tobacco from a vertically extending channel 108 or 110 which communicates with the corresponding horizontal channel through a curved portion of which one is identified as 112 in FIG. 2.

Figure 3:
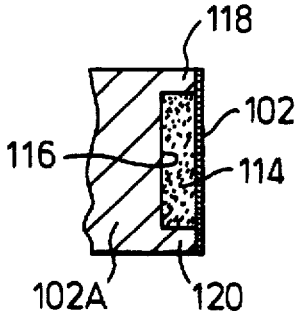
FIG. 3 is a section, on a larger scale, on the line A—A in FIG. 1.

It should be noted that the tobacco is showered onto the inner surfaces of the bands 100 and 102. Thus as each band passes around the pulley 100A or 102A, the tobacco is positively constrained against flying off the band by centrifugal force, being confined in a peripheral groove in the pulley and by the band itself. FIG. 3 shows one of the cigarette filler streams 114 in that situation. The filler stream 114 lies in a peripheral groove 116 in the pulley 102A, while the edges of the band 102 are supported on flanges 118 and 120 on the pulley.

Figure 1:
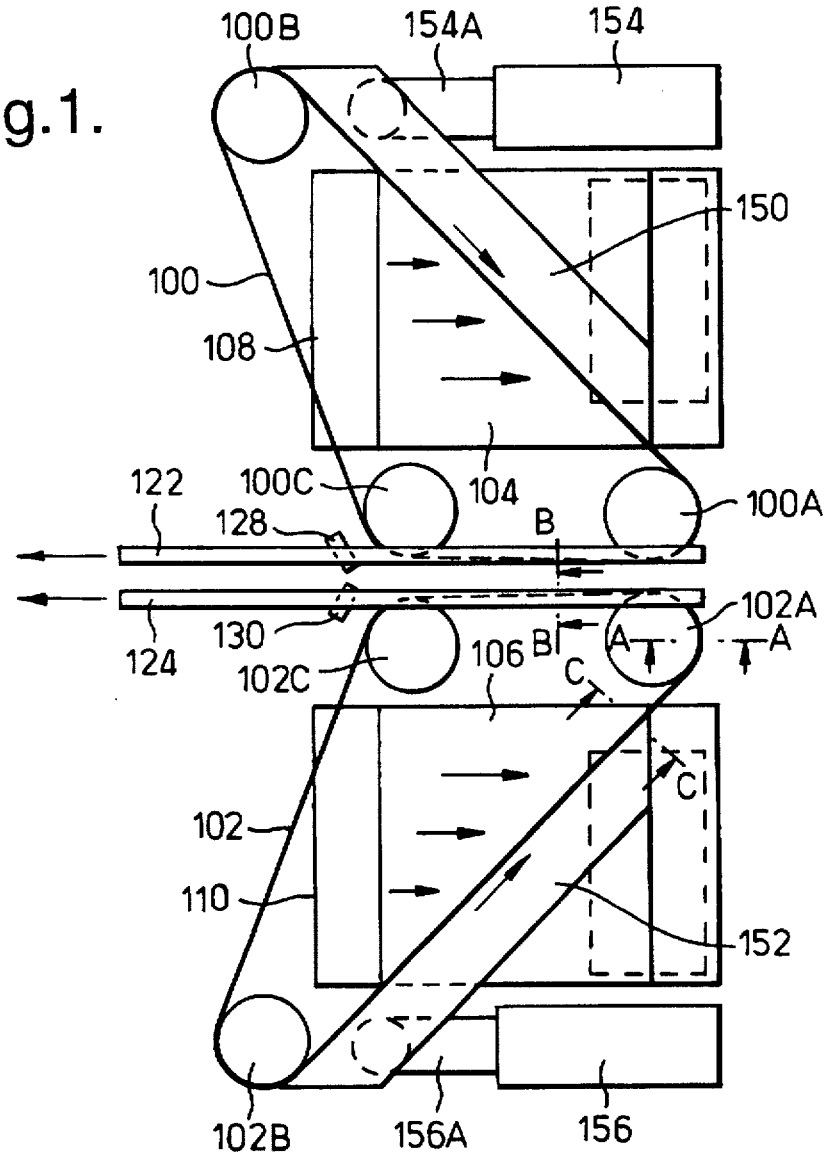
FIG. 1 is a diagrammatic plan view of one machine.

After the filler streams have passed around the pulleys 100A and 102A, they may be subjected to tobacco redistribution processes as described in particular in our British patent application No. 2285246; such redistribution could be arranged to take place while the bands are moving parallel to one another, from right to left as viewed in FIG. 1, and before the filler streams are transferred to overhead suction bands 122 and 124. Each of these overhead suction bands carries the respective filler stream onto a wrapper web 126 (see FIG. 2). Before being deposited on the wrapper web, each filler stream may be trimmed by a trimming device 128 or 130.

Figure 4:
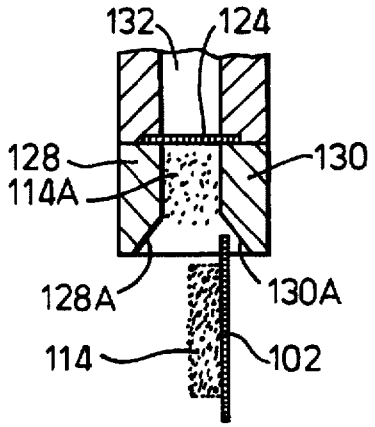
FIG. 4 is a section, on a larger scale, on the line B—B in FIG. 1.

As shown in FIG. 3, each of the filler streams formed on the converging 100 and 102 has a relatively small depth (measured normal to the plane of the band) and a significantly greater width. For example, its dimensions may be 4 mm and 18 mm. FIG. 4, for the purpose of illustration, shows the filler stream 114 in that condition on the band 102, but also shows the cross-section of the filler stream (identified as 114A) after the transfer to the corresponding overhead suction band 124. At this latter stage the filler stream is confined at its sides by rails 128 and 130 of which the inner surfaces are spaced apart, for example, by 8 mm. Thus the filler stream is narrower but deeper, as shown in FIG. 4 by way of example. The rails 128 and 130 have chamfered surfaces 128A and 130A to guide the tobacco drawn upwards from the band 102 and onto the band 124. A suction chamber 132 provides suction for achieving this transfer and for holding the filler stream 114A on the band 124. The arrangement for the other filler stream is similar.

Each of the shower channels is fed with tobacco by a hopper of which one is shown in FIG. 2. Tobacco is delivered, when required, down a chute 134 and slides down a ramp 136 leading to a carded feed drum 138. With the aid of a carded refuser drum 140, a metered carpet of tobacco is conveyed by the drum 138 towards a picker roller 142 which removes the tobacco from the carded drum 138 and projects it along a guide surface 144. Light particles of tobacco are deflected upwards into the vertically extending portion 110 of the shower channel by air admitted through an inlet passage 146, while heavier particles of tobacco pass into a winnowing device 148 which may be of conventional construction and which separates any lighter particles of tobacco from the heavier particles and directs those lighter particles upwards into the shower channel 110.

Suction for drawing the showered tobacco onto the bands 100 and 102 is applied through suction chambers 150 and 152. As shown in FIG. 1, suction may be supplied to those chambers by suction fans 154 and 156 and connecting ducts 154A located adjacent to the outer side surfaces of the two hoppers.

The supercharger louvres commonly used in Molins cigarette making machines may be omitted, and a closed air circuit for each hopper may be employed. For this purpose, all the air drawn through the band 102, for example, by means of the vacuum pump 156 may be redirected into the hopper via the air inlet duct 146. The air system for each overhead suction band 122, 124 may be separate.

Tobacco removed from the filler stream carried by the overhead suction band 124 by the trimming device 130 slides down a ramp 158 so as to return to the tobacco roll between the carded drum 138 and refuser drum 140.

The overhead suction band 124 passes around pulleys 160, 162 and 164, and around a tensioning pulley 166. A wider support band 168 within the band 124 passes around the pulley 160 and around a further pulley 170. This band 168 supports the narrower band 124 up to and just beyond the trimming position, and the band 124 extends beyond the band 168 in order to convey the filler stream effectively into the garniture and more particularly into the concave formed by the wrapper web at the stage at which the filler stream is transferred onto it.

FIGS. 5–7 show a modified arrangement in which the filler stream formed initially on each of the wide bands is in two portions. In principle it could alternatively be in three or more portions.

As shown in FIG. 6, the shower channel 106 is formed by top and bottom horizontal walls 106A and 106B, and in this example the showered tobacco collects on the band 102 in two portions 114A and 114B separated by a fixed dividing wall 172 defining the inner side surfaces of the filler stream portions 114A, 114B. The outer side surfaces of the filler stream portions are confined by fixed rails 174 and 176. Inclined slots 178 and 180 may be left between the members 106A, 174 and 106B, 176 respectively for the admission of air. Suction for drawing the tobacco onto the band 102 is applied through the band (which is preferably a perforated steel band) from suction spaces 182 separated by a wall 184.

As the filler stream portions 114A, 114B pass around the pulley 102A in this example, they are separated by a central flange 186 on the pulley 102A (FIG. 5) which also supports the centre of the band. The flange 186 effectively forms a continuation of the dividing wall 172.

The filler stream portions 114A and 114B may be transferred from the band 102 to the overhead band 124 simultaneously. Alternatively, as shown diagrammatically in FIG. 7, suction applied through the band 102 may first be released in the area of the filler stream portion 114A to permit that portion to transfer to the overhead band 124, and the filler stream portion 114B may be released subsequently. For that purpose a fixed guide member 186 (effectively a continuation of the member 172 and flange 186) is provided to assist in retaining the filler stream portion 114B on the band 102 while the portion 114A is transferring to the overhead band 124. Downstream of the end of the guide member 186, suction applied through the band 102 to retain the filler stream portion 114B is released to permit the tobacco of that portion of the filler stream to transfer (in the region 188) to the overhead band, thus forming an additional layer of tobacco below the layer formed by the filler stream portion 114A.

Showering of tobacco onto the inside surfaces of the bands 100, 102 and in the direction (the triple arrows) opposite to the bands 122, 124 (which correspond to the direction of movement of the finished rods) facilitates a compact machine layout.

Figure 8:
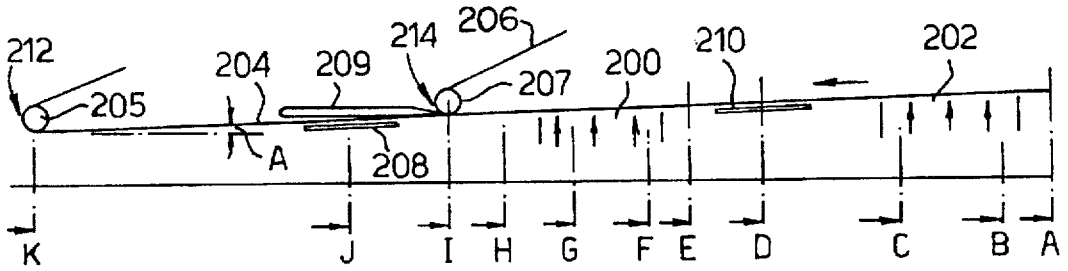
FIG. 8 is a diagrammatic front view of part of a different machine having staggered filler transfer positions, trimmers and garnitures.

FIG. 8 shows a different machine having staggered transfer zones 200 and 202 at which the filler streams are transferred respectively to the front and rear overhead suction bands 204 and 206. The bands 204 and 206 and are both inclined to the horizontal by an angle A which may for example be 3°. Where they carry filler streams, they move along parallel paths. The front and rear filler streams are trimmed respectively by disc-type trimmers 208 and 210 of the type described, for example, in our U.S. Pat. No. 3,712,160.

Because of the downward inclination of the bands 204 and 206 (which is usual for efficient delivery of the filler streams into the garnitures and more particularly onto the paper wrapper webs), garniture entry points 212 and 214 for the two tracks (below pulleys 205, 207 for the bands 204 and 206 respectively) are at different levels. The wrapper web which carries the rear filler stream, after receiving it at the garniture entry point 214, continues along a horizontal path (being identified by numeral 209 in FIG. 8) and passes over the trimmer 208 for the front filler stream. Likewise the wrapper web and the completed cigarette rod produced by the front track of the machine will continue horizontally from the garniture entry point 212. Thus the two completed cigarette rods are at different levels, the rear rod being at a higher level so that components of the machine dealing with it are readily visible over the top of the front rod.

Because of the staggered arrangements of the garnitures, ready access is available to both, and each can be independently controlled, for example, for the purpose of setting them to produce cigarettes of the required diameter. Moreover, the nozzles for applying adhesive to the edges of the paper webs to form the necessary longitudinal seals can, since they are at different levels and are staggered, be set at ideal angles. The positions of the nozzles are shown in FIG. 12, which is a cross-section through the machine downstream of the nozzles (not shown in FIG. 8) and looking back towards the nozzles.

Figure 12:
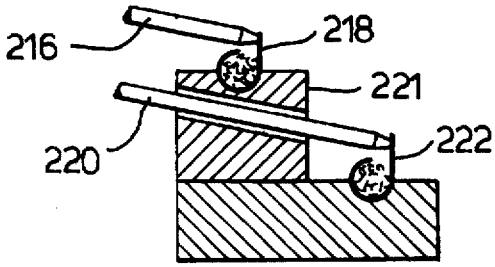
FIG. 12 is a cross-section showing the adhesive application nozzles.

As shown in FIG. 12, a nozzle 216 for the rear track applies adhesive to the upwardly extending edge 218 of the wrapper web for the rear track before the edge is folded down onto the other edge to form a longitudinal seal. A nozzle 220, set at the same angle as the nozzle 216, extends through a bore in a member 221 supporting the rear web and applies adhesive to the corresponding edge 222 of the wrapper web for the front track. This contrasts importantly with a prior competitive arrangement which has the two tracks at the same level and the nozzles (not staggered) at the same angle, but at the expense of applying adhesive to different edges of the wrappers so that the cigarettes produced by the two tracks differ in the manner of overlap of the wrapper edges.

The actual angle of inclination of each of the nozzles 216, 220 shown in FIG. 12 is illustrative and is not intended to represent the ideal angle of inclination which is typically 10° to the horizontal.

Figure 10:
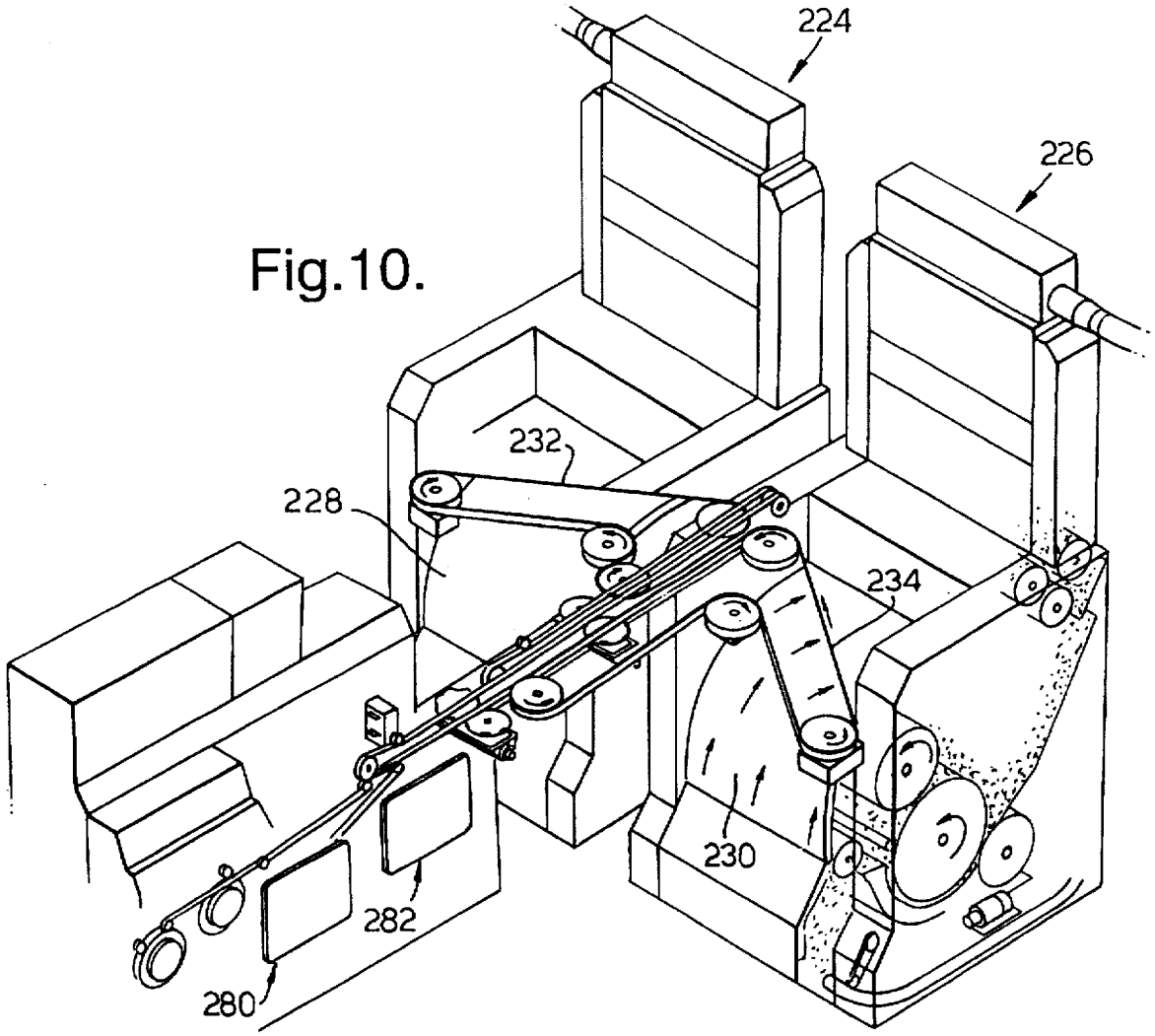
FIG. 10 is a diagrammatic perspective view of part of the machine.

FIG. 10 illustrates the general arrangement of the machine. In particular, it shows that the machine has two identical hoppers 224 and 226 which are laterally spaced and are arranged to feed metered carpets of tobacco into the lower ends of upwardly extending shower channels 228 and 230 which are curved so that the showered tobacco emerging from their upper ends is directed horizontally onto the inner surfaces of two wide suction bands 232 and 234 corresponding to the bands 100 and 102 in the machine shown in FIG. 1. The bands 232, 234 and the overhead bands 204, 206 are shown more clearly in FIG. 11.

Figure 11:
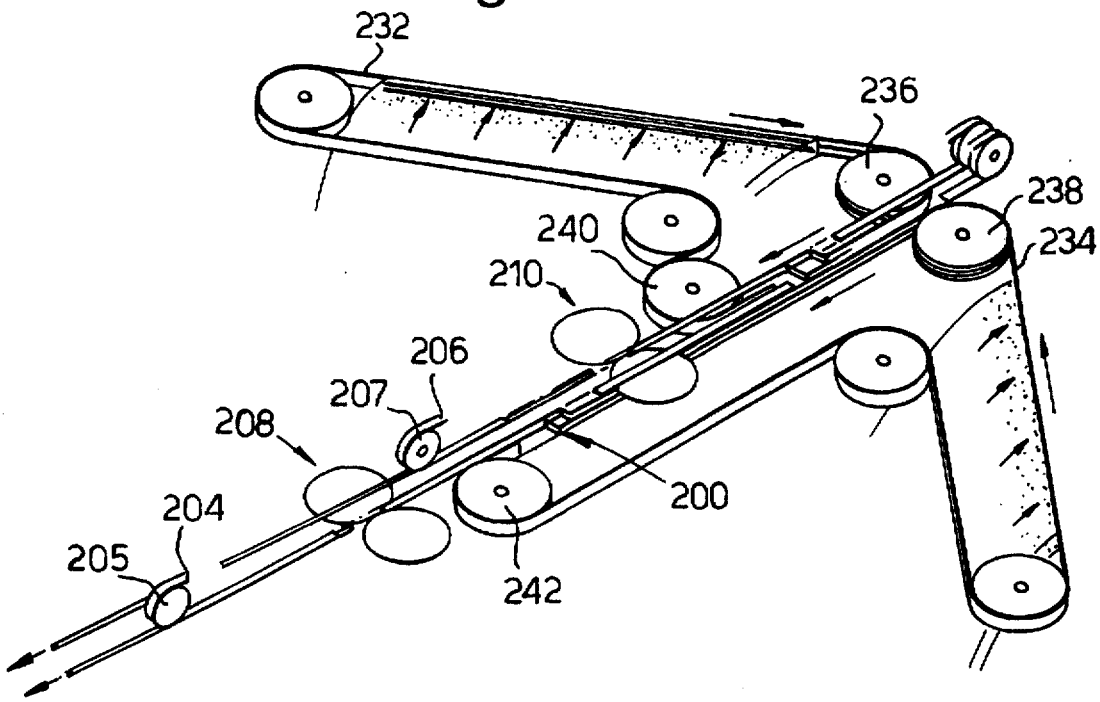
FIG. 11 is a perspective view, on a larger scale than FIG. 10, of the suction bands.

As shown in FIG. 11, the converging runs of the bands 232 and 234 (which receive the showered tobacco) move towards pulleys 236 and 238 and, after passing around those pulleys, move in parallel directions. However, in contrast with the arrangement shown in FIG. 1, the next pulleys 240 and 242 for the respective bands are staggered to allow the transfer of tobacco from the front band 234 to occur in the region 200 which is downstream of the pulley 240 and the trimmer 210.

The transfer of tobacco from the bands 232, 234 to the overhead bands 204, 206, and the sequence of operations performed in the two tracks of the machine, are shown more particularly in FIGS. 9A–9K.

Figure 9C:
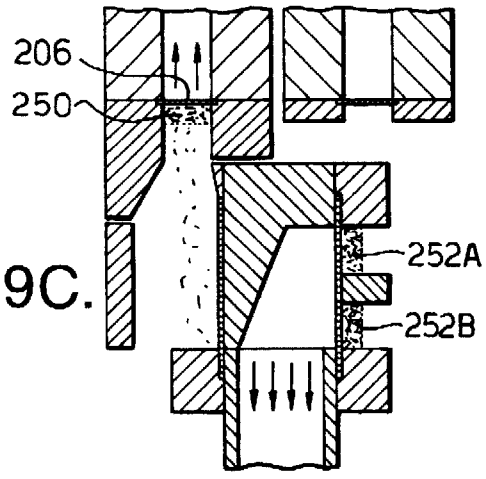
FIGS. 9A–9K are fragmentary vertical cross-sections on lines A–K in FIG. 8.
Figure 9B:
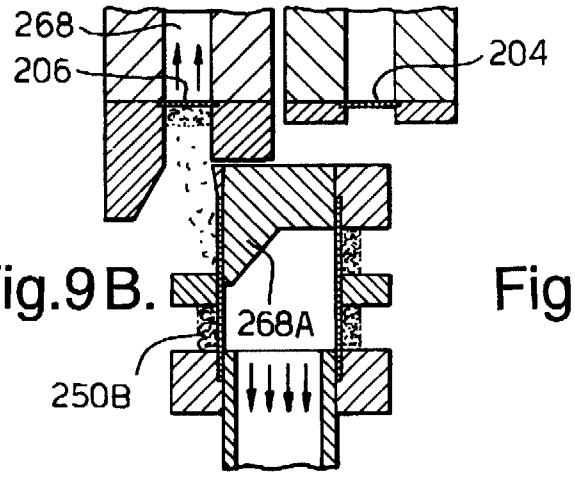
Figure 9A:
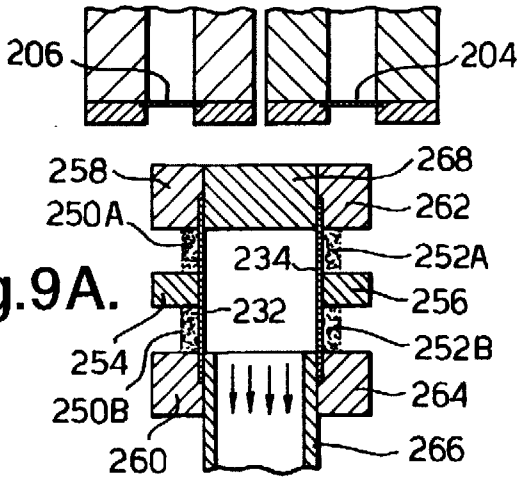
Figure 9D:
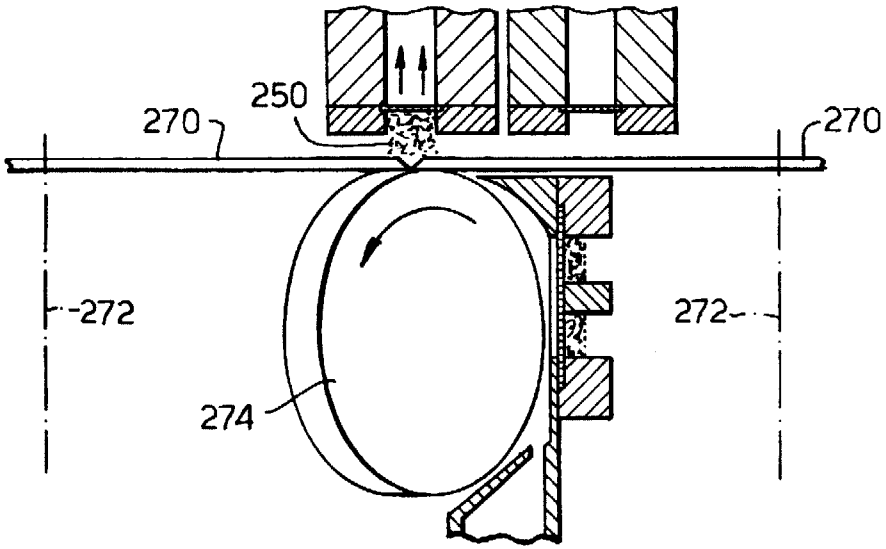
Figure 9E:
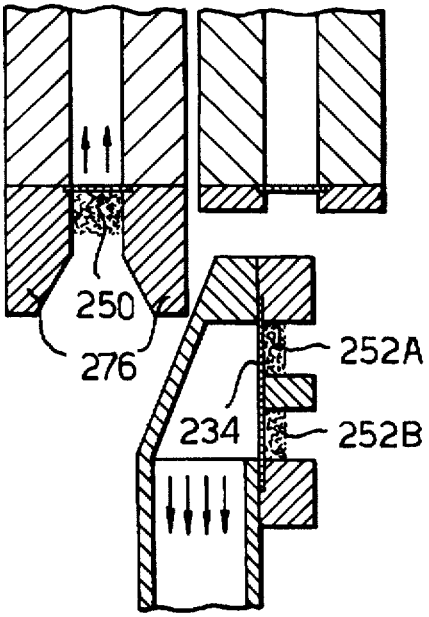
Figure 9F:
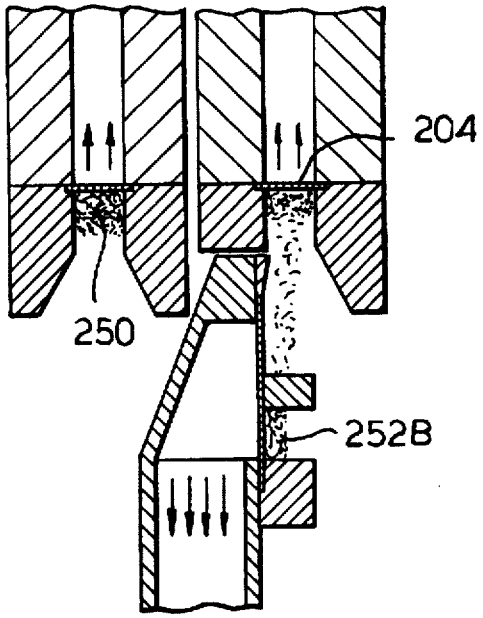

FIG. 9A is a section on the line A in FIG. 8 and shows the bands 232, 234 after they have passed around the pulleys 236, 238. Each carries a cigarette filler stream 250 or 252 which is in two parts A and B separated by guides 254 and 256 respectively. Outer surfaces of the filler streams are confined and guided by members 258, 260, 262, 264 which also guide the edges of the bands 232, 234. Suction for holding the tobacco stream portions on the bands is provided by a suction manifold 266, as indicated by air flow arrows, the same indication of suction being used elsewhere where applicable. A further member 268 supporting the opposed surfaces of the upper edges of the bands 232, 234 is of rectangular cross-section at this stage. The overhead suction bands 204, 206 are guided as shown.

At stage B (FIG. 9B), the cross-sections of the fixed parts allows the tobacco stream portion 250A to be drawn upwards onto the band 206 by suction applied through the band from a manifold 268, suction being cut off from the upper portion of the band 232 by a projecting portion 268A of the member 268. By stage C (FIG. 9C), this projecting portion 268A has cut off suction from the entire surface of the band 232 to permit the lower filler stream portion 250B to transfer to the band 206, the divider 254 having previously terminated.

At stage D (FIG. 9D), the filler stream 250 carried by the band 206 is trimmed by a trimming device comprising cooperating discs 270 rotating about axes 272, and a brush member 274 (shown here diagrammatically simply as a wheel) which brushes away excess tobacco lying below the discs 270. Parts of the machine which guide the tobacco and which transmit suction to the band 234 are cut away as necessary to make room for the trimming device.

Figure 9G:
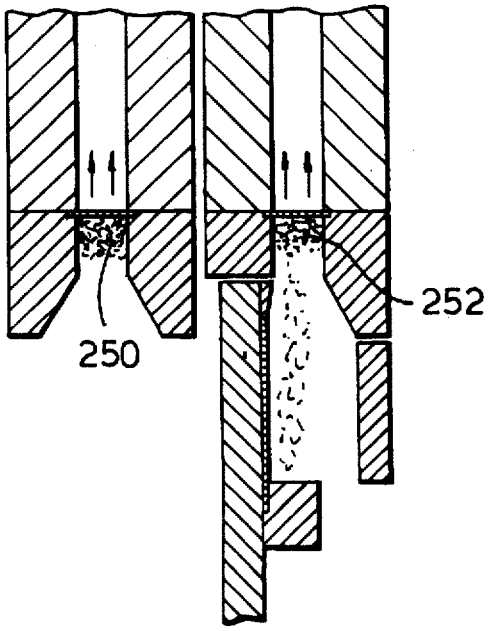
Figure 9H:
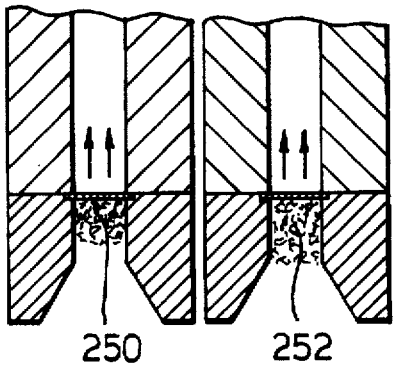

At stage E (FIG. 9E), the trimmed rear filler stream 250 has its sides guided by rails 276 while suction continues to be applied through the wide band 234. At stage F (FIG. 9F), suction is cut off from the upper part of the band 234 to allow the filler stream portion 252A to transfer to the front overhead suction band 204. This is followed by the transfer of the lower filler stream portion 252B at stage G (FIG. 9G).

Figure 9I:
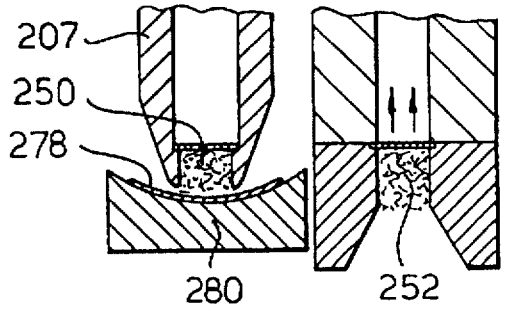
Figure 9J:
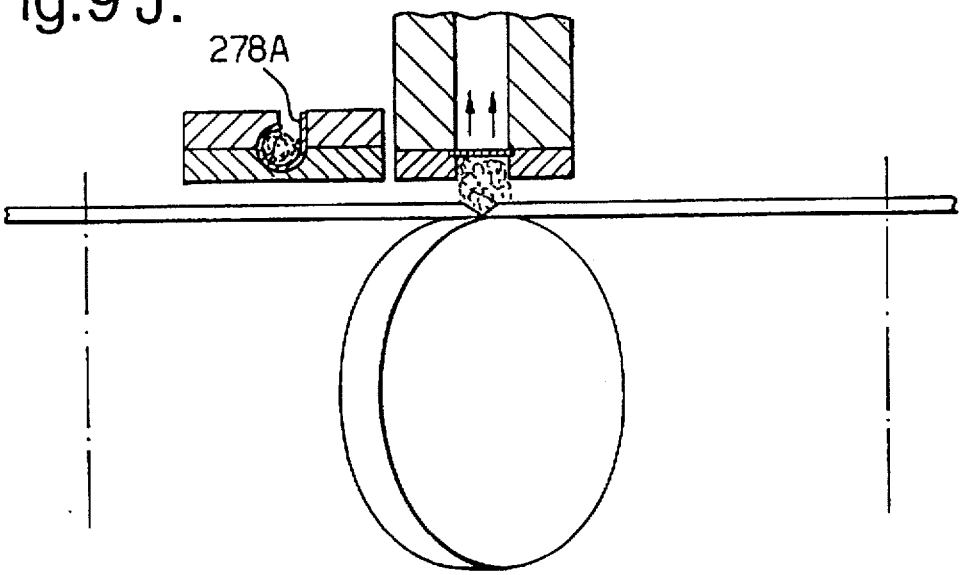

At stage H, the front filler stream 252 is ready for trimming (which occurs at stage J) (FIG. 9J), but before trimming takes place the rear filler stream 250 is deposited on a wrapper web 278 carried by a garniture tape (not shown) running along a garniture bed 280 (see FIG. 9I). Beyond this point, the filler stream 250 continues horizontally while the wrapper web 278 is partially wrapped around it (see FIG. 9J) in readiness for the application of adhesive to the upwardly extending edge 278A of the web by a nozzle (not shown) to complete the rear cigarette rod.

Figure 9K:
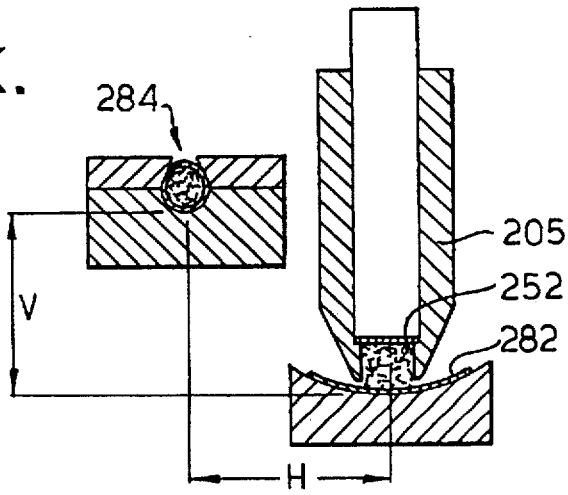

Finally, FIG. 9K shows the front filler stream 252 being deposited on a wrapper web 282, by which stage the difference in level between the completed rear cigarette rod 284 and the rod which is about to be formed with the filler stream 252 is shown by the dimension V which may, for example, be 27 mm. The horizontal spacing between the two filler streams (dimension H) may for example be 30 mm.

Referring again to FIG. 10, printing devices 280 and 282 for applying the desired print respectively to the front and rear wrapper webs are in staggered positions so that each is readily accessible.

The raised level of the rear track enables a common cut-off device for both rods to be set at a convenient orientation. This can readily be understood if the cut-off device is assumed to be of the type described in British patent 945662 or 971260. If the two rod lines were at the same level, the rotary body of the cut-off (which may have two diametrically opposed knives) could be positioned centrally below or possibly above the two rod lines: i.e., with a vertical line through its axis of rotation at right angles to and bisecting a line (horizontal in this case) through the axes of the two rods. The sharpening wheels would then be at 3 o'clock and 9 o'clock positions, and the rear sharpening wheel would be highly inaccessible. By raising the rear rod line (e.g. by 27 mm) as we propose, the line joining the axes of the two rods is tilted by, for example, approximately 42° to the horizontal (assuming that the horizontal spacing of the rods is 30 mm). This means that the rear sharpening wheel is raised significantly and is therefore far more accessible to the operator. Also, the rearward displacement of the cut-off (assuming that the cut-off is below the rods) is beneficial in that it represents less of a forward projection beyond the cigarette rods.

The ledger may comprise a constant-orientation rotary device for supporting both rods. For example, it may be based on a planetary system or it may be similar in principle to the ledger described in our British patent No. 1332689, the axis or axes of rotation being at right angles to a line joining the axes of the two cigarette rods. In either case a common rod supporting member (or a number of such members) would support each rod while the cut-off device makes each pass during which it cuts through both rods in quick succession.

As an alternative, the cigarette filler streams formed on the two wide bands 232, 234 may be as shown in FIG. 3: that is to say, omitting the dividing guides 254, 256. The upward transfer of each filler stream 252, 254 onto the corresponding overhead conveyor 204, 206 may be assisted by an additional band converging towards the overhead band, for example by an angle of 10°. Each additional band may be perforated or porous, and suction may be applied through it from below while it is converging towards the overhead band. During this transfer process no suction is applied either through the wide band or (preferably) through the overhead band, but suction is applied through the overhead band as soon as the transfer has been completed.

At the end of its convergent path (towards the corresponding overhead band) each transfer band preferably passes around a pulley and then moves parallel to the overhead band, for example through a distance of approximately 60 mm; the spacing between the two bands at this stage may be approximately equal to the average height (depth) of the cigarette filler stream, for example 12 mm. The transfer band may move at a slightly greater speed than the overhead band and thus serve to drag forward tobacco peaks and consequently cause the filler stream to become more even in height. For example, the speed of the transfer band may be such that the component of its motion which is in the direction of the overhead band as it converges towards the overhead band is equal to the speed of the overhead band.

Instead of the filler streams being formed on the suction bands 204, 206 by being transferred from wide bands (232, 234) as shown in FIGS. 8 to 12, they may be formed by showering tobacco upwards and directly onto the bands 204, 206 in zones 200, 202.

The staggering of the transfer (or shower) zones 200, 202, the trimmers 208, 210 and the rod-forming arrangements 212, 214 results in the rod-forming processes in the two tracks being more similar than has hitherto been possible.

Figure 13:
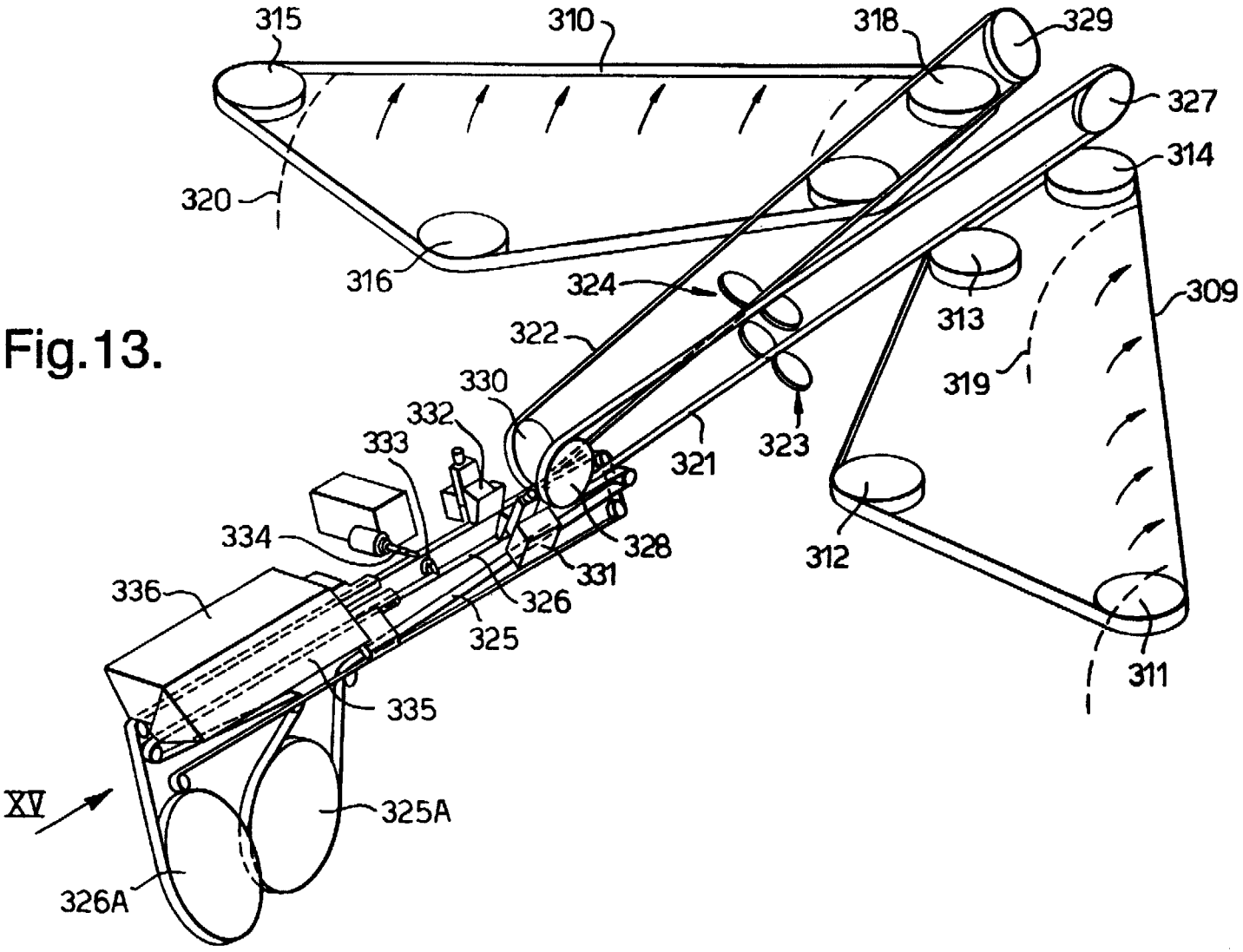
FIG. 13 is a perspective view of another different machine according to this invention.

FIG. 13 shows a different twin track machine in which cigarette filler streams for the front and rear tracks are formed initially on suction bands 309 and 310 moving in vertically offset horizontal planes, the plane of the band 310 being at a higher level. The band 309 passes around pulleys 311 to 314 having approximately vertical axes of rotation, while the band 312 passes around similar pulleys 315 to 318. Tobacco for the front track is showered through a chimney 319 extending upwards and then along a curve so as to deliver the showered tobacco horizontally onto the inside surface of the band 309. Similarly, the tobacco for the rear track is showered through a chimney 320 onto the inside surface of the band 310.

The cigarette filler streams formed on the bands 309 and 310 are transferred to overhead suction bands 321 and 322 respectively which carry the filler streams past trimming devices 323 and 324 by which the filler streams are trimmed before being deposited by the bands 321 and 322 on paper webs (not shown) carried by garniture tapes 325 and 326 with the aid of which the paper webs are wrapped around the trimmed filler streams to form continuous cigarette rods moving along laterally spaced parallel paths. The tapes are driven by tape drums 325A, 326A.

The suction band 321 passes around pulleys 327 and 328, and the band 322 passes around similar pulleys 329 and 330.

Figure 15:
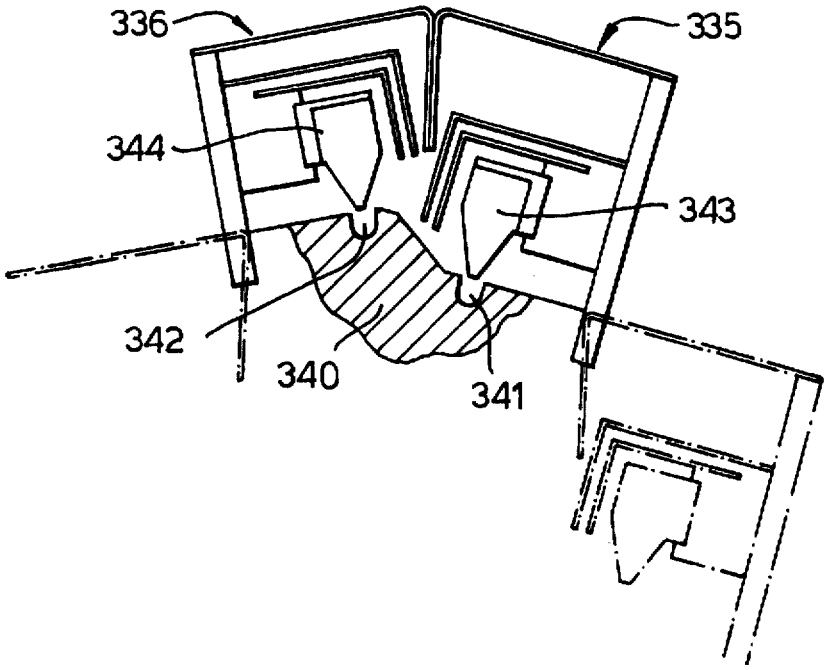
FIG. 15 is a partly sectioned view in the direction of the arrow XV in FIG. 13.

Folders 331 and 332 for the front and rear tracks form parts of the usual garnitures by which the paper webs are wrapped around the filler streams. Glue nozzles 333 and 334 apply adhesive to the front edges (inside surfaces) of the paper webs before they are pressed down to seal on the rear edges. Heaters 335 and 336 then press on the edges to set the glue and secure the seals; further details of these heaters are shown in FIG. 15 and are described below.

Compared with a conventional single-track cigarette maker, all the components used to form each rod in this machine are tilted while retaining the usual orientation with respect to the corresponding suction band 321 or 322 and filler stream. The titling of the heaters (away from one another) is shown in FIG. 15.

Figures 16, 17, 18, 19:
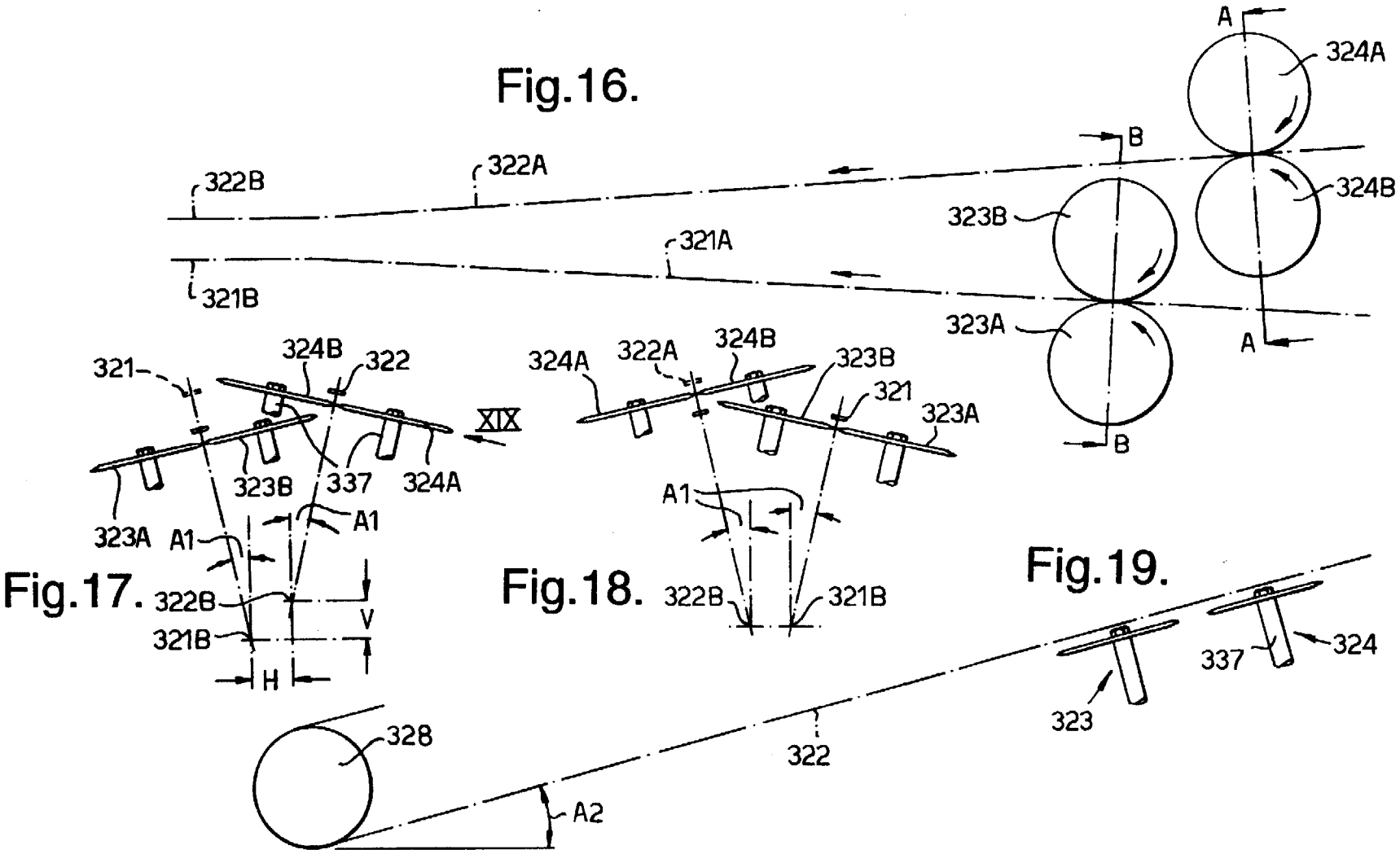
FIG. 16 is a partial plan view of the machine shown in FIG. 13 in the region of the trimmers.
FIG. 17 is a section on the line A—A in FIG. 16.
FIG. 18 is a section similar to FIG. 17, but on the line B—B in FIG. 16 and showing a modified machine.
FIG. 19 is a side view in the direction of the Arrow XIX in FIG. 17.

Each of the trimming devices 323 and 324 comprises a pair of flat trimming discs 323A, 323B and 324A, 324B shown more particularly in FIG. 17, which also shows shafts 337 on which the discs are mounted and by which they are driven; the discs may include dense ending pockets or recesses, for example as described in U.S. Pat. No. 3,032,041.

As seen in the plan view which is FIG. 16, the axes 321A and 322A of the overhead suction bands 321 and 322 converge towards the left so as to be spaced further apart in the region of the trimming discs than they are at their left-hand (downstream) ends corresponding to the positions of the pulleys 328 and 330 shown in FIG. 13. Parallel lines 321B and 322B represent the horizontal axes of the cigarette filler streams and completed cigarette rods as they are carried by the garniture tapes 325, 326. This convergence of the suction tapes 321, 322 is achieved by virtue of the fact that the entire suction tape assemblies including pulleys 327, 328 and 329, 330 are tilted away from one another about the parallel axes 321B and 322B. This tilt is shown in FIG. 17, the angle of tilt in each case being shown as the angel A1.

The result of tilting the entire suction tape assemblies about the axes 321B, 322B is that the upstream ends of the suction bands are substantially further apart than the downstream ends. As well as the benefit this brings with regard to trimming of the streams, the gap between the upstream ends of the suction bands is useful in that it allows machine components to be placed in and/or be accessed through the gap. For example, suction chambers above the lower runs of the bands (for attracting the filler streams to the bands) may be supplied with suction via pipes or passages located conveniently in the gap between the suction chambers.

As shown in FIG. 17, the spacing between the bands 321 and 322 in the region of the trimming devices is sufficient to ensure that the trimmer disc 323B for the front filler stream does not extend across to and interfere with the rear filler stream, and likewise in the case of the trimmer disc 324B.

FIG. 17 also shows that the axes 321B and 322B of the front and rear cigarette rods are spaced apart vertically by the distance V (for example 27 mm) as well as being horizontally spaced by the distance H, for example 30 mm. The axes 321B, 322B may alternatively be at the same level, as shown in FIG. 18. FIG. 18 is a diagrammatic section on the line B—B and shows the position of the trimming discs 323A, 323B in relation to the band 321 carrying the front cigarette filter; and it also shows the other suction band 322 at the same level, while showing the suction band 322 at a position 322A in the region where the rear filler stream is trimmed by the trimming discs 324A, 324B.

Figure 20:
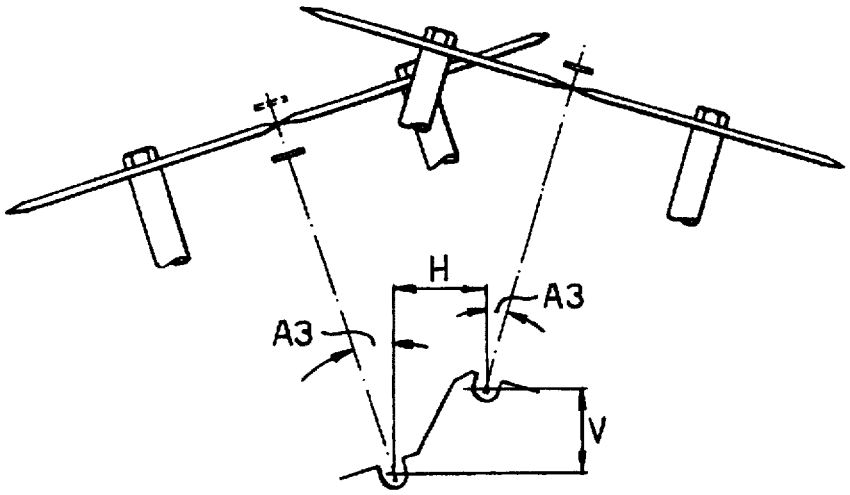
FIG. 20 is a view similar to FIG. 17, but of a modified machine.
Figure 21:
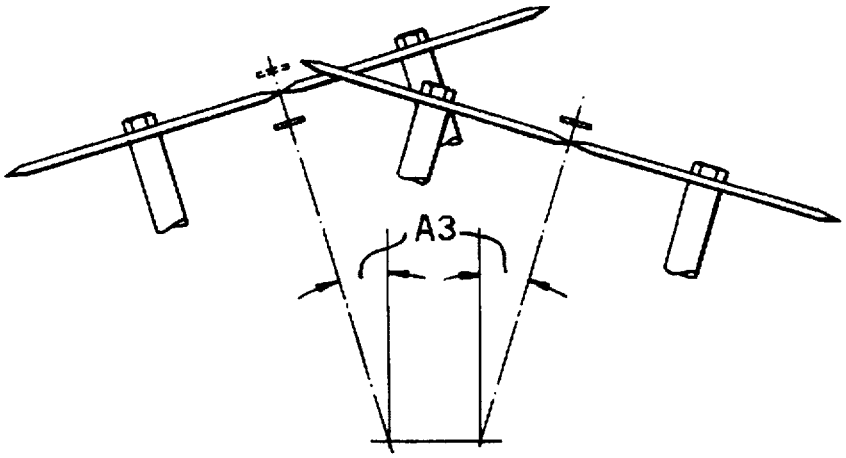
FIG. 21 is a view similar to FIG. 18, but of another modified machine.

FIG. 19 shows the angle A2 by which the suction band 322 is inclined to the axis of the front cigarette rod. This angle is shown as 15°. However, it may be greater or smaller. If it is made smaller then the tilt angle A1 needs to be increased in order to achieve the same spacing between the suction bands 321, 322 in the region of the trimming discs, unless the bands 231, 322 are increased in length to allow the trimming discs to be further back in relation to the downstream ends of the bands. In FIGS. 17 and 18 the tilt angle A1 is shown as approximately 13°. FIGS. 20 and 21 are similar respectively to FIGS. 17 and 18 and show an increased tilt angle A3 which is approximately 17°.

Figure 22:
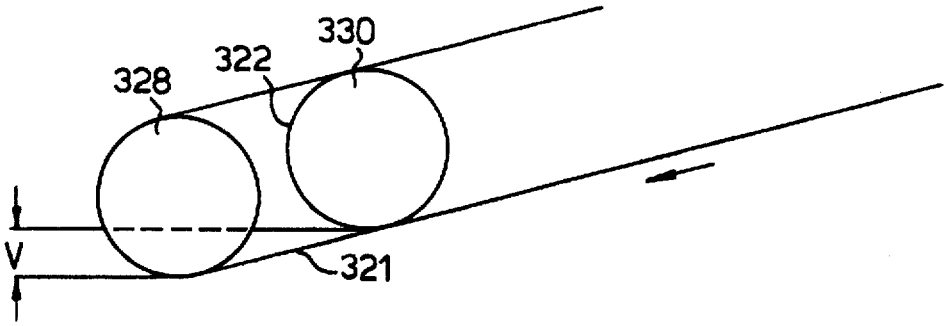
FIG. 22 is a diagrammatic front view (similar to part of FIG. 19) of a differently modified machine.

FIG. 22 shows an alternative way in which a vertical spacing can be achieved between the front and rear cigarette rods. In this example, the two suction bands 321 and 322 are in a common plane, as in the examples described above with reference to FIGS. 18 and 21, but the return pulley 328 for the band 321 has been moved so that the filler stream on the band 321 is deposited on its garniture tape in a position downstream and lower than the position at which the filler stream on the band 322 is deposited on its garniture tape. Thus the points at which the filler streams are deposited on the respective garniture tapes and begin to be formed into cigarette rods are staggered. The folders 331, 332 and the glue nozzles 333, 334 may be correspondingly staggered, as also the heating devices 335, 336 if so desired.

FIG. 15 shows further details of the rod heaters shown in FIG. 13. Firstly is should be noted that the cigarette rods are formed in this example on a common garniture bed 340 formed with grooves 341 and 342 respectively for the front and rear garniture tapes (not shown here). The rod heaters comprise respectively members 343 and 344 having lower edges which will extend along and press on the seams formed by the wrapper webs, these members 343 and 344 being heated. The heater 335 is carried by a structure whereby it can be moved to the position shown in dotted outline when the heater is not in use. It will be understood that this structure may involve a four-bar or other parallel-motion linkage so that the heater 343 can be dropped to the position shown in dotted outline while remaining in a constant orientation. A similar arrangement may apply to the other heater, so as to swing in the opposite direction away from the vertical plane between the cigarette rods.

Figure 14:
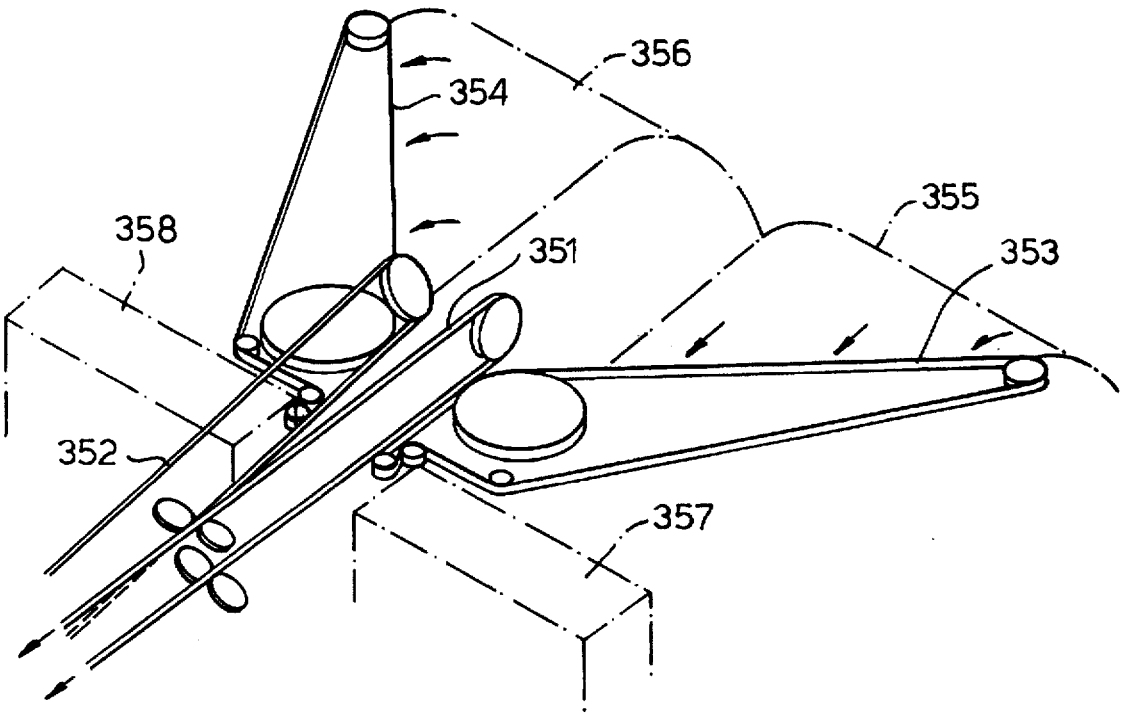
FIG. 14 is a perspective view of part of a different machine.

FIG. 14 shows an arrangement different from FIG. 1 but involving overhead suction bands 351 and 352 which perform the same function as the bands 321 and 322 in FIG. 13. The difference here is that the filler streams are formed by showering tobacco onto the outside surface of horizontal bands 353 and 354 through chimneys 355 and 356, generally as described in our British patent application No. 2294626 .

Box-like structures 357 and 358 represent parts of two separate tobacco hoppers through which tobacco is fed and metered before being received by the chimneys 355 and 356. Similarly positioned (spaced apart) hoppers may be used in the other cigarette making machines described in this specification.

Instead of the filler streams being formed by showering tobacco onto the horizontal bands 309, 310 in FIG. 13 or 353, 354 in FIG. 14, they may be formed by showering tobacco directly onto the underneath surfaces of the overhead bands 321, 322, for example as described in the above-mentioned U.S. Pat. No. 3,338,247. For this purpose two separate hoppers similar to those used in single-track cigarette making machines of any desired type may be used; for example, they may form mirror images of one another on opposite sides of a central vertical plane between the bands 321, 322.

As already mentioned, the spacing apart of the bands 321, 322 in the region of their upstream ends would, in this situation (and also in machine layouts as shown in FIGS. 13 and 14), be helpful in allowing a central access space in which, for example, suction delivery pipes for suction chambers above the lower runs of the bands 321, 322 may be located. Each hopper may be pivotally movable about a vertical axis so that it can be swung away from the other hopper to allow access to inner parts.

We claim:

1. A twin-track cigarette making machine arranged to form two closely spaced continuous cigarette rods having parallel axes, the filler streams used to form the cigarette rods being conveyed towards the respective rod-forming devices by suction bands arranged to move along converging paths and to be tilt away from one another about the respective rod axes.

2. A method of making cigarettes, in which tobacco is showered onto the inside surface of a suction band passing around a number of pulleys having approximately vertical axes of rotation, so as to form on the band a cigarette filler stream which passes around one of the pulleys, while lying between the pulley and the band, and is then arranged to transfer to a second band which transports the filler stream towards a rod-forming device by which the filler stream is enclosed in a wrapper web to form a continuous cigarette rod.

3. A cigarette making machine comprising a channel, a first band in the form of a suction band passing around a plurality of pulleys having approximately vertical axes of rotation located so as to receive tobacco showered through the channel on the inside surface thereof so as to form on the first band a cigarette filler stream which passes around the pulleys between the pulleys and the first band, and a second band arranged so as to receive the filler stream and transport the stream toward a rod-forming device located downstream of the second band by which the filler stream is enclosed in a wrapper web to form a continuous cigarette rod.

4. A cigarette making machine according to claim 3, in which the first band is significantly wider than the second band and is arranged to receive the filler stream in a form which, in cross-section, is significantly wider than it is deep, the cross-section of the filler stream being arranged to change, upon transferring to the second band, so as to be narrower and deeper.

5. A cigarette making machine according to claim 3, including a trimmer for trimming the filler stream while it is being carried by the second band.

6. A cigarette making machine according to claim 3, in which the part of the first band onto which the tobacco is showered is arranged to move in a direction inclined to the showered tobacco so that the showered tobacco arrives at the band with a component of movement in the direction of movement of the band.

7. A cigarette making machine according to claim 3, in which the direction of movement of the showered tobacco as it approaches the first band is opposite to that of the cigarette rod.

8. A cigarette making machine according to claim 3, in which the channel through which tobacco is showered includes an upwardly extending portion leading to a horizontally extending portion via a curved portion.

9. A cigarette making machine according to claim 3, in which the pulley around which the filler stream passes while lying on the inside surface of the first band has flanges which define a peripheral groove for the passage of the filler stream, and which support the edges of the band.

10. A cigarette making machine according to claim 3, in which the transfer of tobacco from the first band to the second band is assisted by an additional band which converges towards the first band.

11. A twin-track cigarette making machine comprising first and second tracks, each formed according to claim 15, and in which the first bands of both tracks on which the filler streams are initially formed are substantially parallel to one another in the regions where the filler streams on them are transferred to the respective second bands.

12. A twin-track cigarette making machine, comprising first and second cigarette rod forming tracks formed by two substantially parallel suction bands, means for feeding tobacco onto the suction bands at staggered positions relative to the direction of movement of the bands, trimming devices for trimming the filler streams located at similarly staggered positions and rod-forming devices located at similarly staggered positions in relation to one another in the direction of movement of the bands.

13. A cigarette making machine according to claim 12, in which components of one track are located downstream of corresponding components of the other track, and the suction band for the one track continues, along a downwardly inclined path, beyond the entry point of the rod-forming device for the other track, whereby the cigarette rod of the one track is formed at a lower level than the cigarette rod of the other track.

14. A cigarette making machine according to claim 12, in which the filler streams are formed on the respective suction bands by a transfer of tobacco from wider bands with the assistance of further bands which respectively converge towards the wider bands.

* * * * *